US009891020B2

(12) United States Patent
Jen

(10) Patent No.: US 9,891,020 B2
(45) Date of Patent: Feb. 13, 2018

(54) MULTI-PLATFORM ERGONOMIC FOREGRIP

(71) Applicant: Yi Huei Jen, Irvine, CA (US)

(72) Inventor: Yi Huei Jen, Irvine, CA (US)

( * ) Notice: Subject to any disclaimer, the term of this patent is extended or adjusted under 35 U.S.C. 154(b) by 0 days.

(21) Appl. No.: 14/675,484

(22) Filed: Mar. 31, 2015

(65) Prior Publication Data

US 2016/0290760 A1 Oct. 6, 2016

(51) Int. Cl.
*F41C 23/00* (2006.01)
*F41C 23/16* (2006.01)

(52) U.S. Cl.
CPC ..... *F41C 23/16* (2013.01)

(58) Field of Classification Search
CPC ..... F41C 23/16
See application file for complete search history.

(56) References Cited

U.S. PATENT DOCUMENTS 8,707,604 B2 * 4/2014 Troy ..... F41A 23/10 248/169
2011/0179688 A1 * 7/2011 Ash, Jr. ..... F41C 23/16 42/72
2015/0233668 A1 * 8/2015 Moore ..... F41C 23/16 42/72

* cited by examiner

*Primary Examiner* — Kristen Matter

(57) ABSTRACT

A foregrip for use with a firearm having a handguard mounting platform. The foregrip comprises a unitary body attachable to a handguard and configured with a front end, an intermediate section and a rear end. A front end designed to form a vertical engagement portion, an intermediate section designed to be partially curved engagement section and extending from the front end to the rear end, and a rear end designed to form a top portion and a lower portion. The top portion forming a first angled engagement portion, and the lower forming a second angled engagement portion. An attachment surface provides a method for mounting the foregrip onto a firearm handguard.

3 Claims, 4 Drawing Sheets

MULTI-PLATFORM ERGONOMIC FOREGRIP

Presently, many shooters utilize different accessories to enhance their firearm and provide additional functionality which allows for improved firearm utilization. One such accessory is the firearm foregrip. One of the most popular firearm accessories is the foregrip. A firearm foregrip is typically attached onto a handguard rail via different mechanisms that allow a user to essentially customize their firearm. This accessory acts to provide a stable position on the fore end of the firearm to guide the shooters support hand as well as to allow the shooter to apply some rearward pressure to the grip and in turn allows the shooter to firmly seat the firearm against their shoulder. Fortunately, a user is not limited to one specific design of foregrip, as there are vertical grips and angled grips. Each serves a similar purpose, but the angled foregrip typically maintains the functionality of the vertical grip while providing additional capability and support hand ergonomics. The ergonomic functionality comes from the ability for a user to properly utilize their support hand, especially for long periods of engagement, without the wrist strain associated with using a vertical grip. Therefore, many shooters have a preference to utilize the angled foregrip. In addition to its ergonomic functionality, an angled foregrip allows a shooter to employ different support hand holding techniques.

Now the issue shooters have encountered with the angled foregrip is its ability to be utilized on different handguard mounting platforms. Current foregrip mounting mechanisms utilize a KeyMod mounting mechanism which is a standard mounting platform for mounting accessories onto a handguard. A second mounting mechanism, which was recently developed but becoming more popular and heading towards being a standardized mounting platform is the M-LOK platform. This platform provides many advantages over previous mounting platforms while maintaining the strength of attachment mechanism. Unfortunately, M-LOK is being slowly phased in as the standard platform. Unfortunately, costs and availability of accessories that can mount on the M-LOK platform have caused some shooters to consider the short term advantages of utilizing an M-LOK platform. On the other hand, some early adopters of the M-LOK platform have found that they cannot utilize their KeyMod mounting accessories with their M-LOK platform. Hence, they must discard their accessories or sell them to purchase new ones. As previously mentioned, the firearm foregrip is one of the most, if not the most, popular accessory for a shooter to add to their firearm. Most are made to fit the KeyMod platform, which is good for those still utilizing the old platform, but those whom have adopted to M-LOK platform are found wanting as foregrips are slowly being developed to meet the shooters' needs. Therefore, it is apparent that there is a need for a foregrip that can be attached to the older KeyMod platform as well as the newer M-LOK platform, while still maintaining the strength and stability of the proven KeyMod foregrip designs.

SUMMARY

Accordingly, it is an object of the present invention to a multi-platform ergonomic foregrip which can be attached onto different mounting platform handguards. The foregrip comprises a base adapted to engage a handguard rail, a front end portion, a rear end portion, and an intermediate portion. The front end portion features two engagement surfaces that are generally vertical in relation to the attachment rail on which it is attached, and can be engage by a users' hand or finger to provide additional firing control. The rear portion features two additional engagement surfaces that also allow a user to utilize different firearm control hand techniques via a partially curved portion and an angled portion. Finally, the intermediate portion is partially curved and partially horizontal and connected the front end to the rear end. The design of the intermediate section provides maximum ergonomic positioning for a shooters hand to be placed when utilizing different firearm control hand techniques.

The invention is best understood through examination of the description of drawings as well as the accompanying figures.

DESCRIPTION OF DRAWINGS

The following descriptions are set forth and have been assigned numerical designations to enable the reader to understand the reasoning behind and the application of the present invention. These, as well as other features of the present invention, will become more obvious when taken with reference to the drawings.

DETAILED DESCRIPTION OF DRAWINGS

Figure 1:
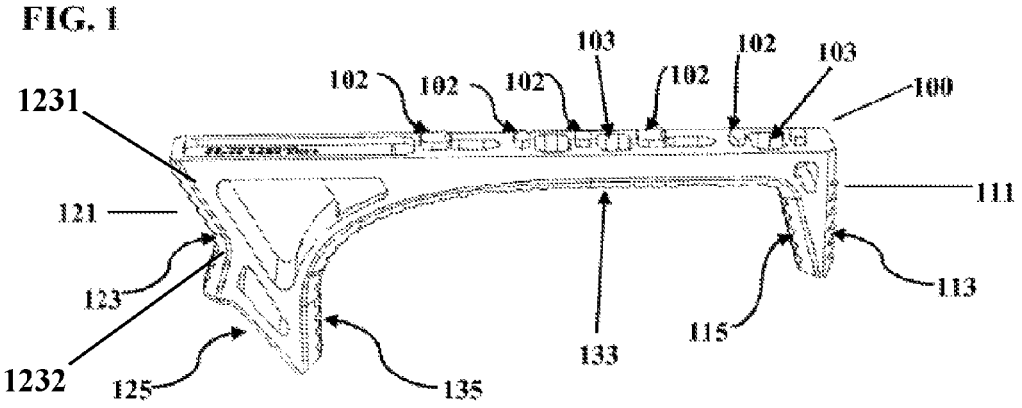
FIG. 1 is an illustration the present invention, Multi-Platform Ergonomic Foregrip.
Figure 2:
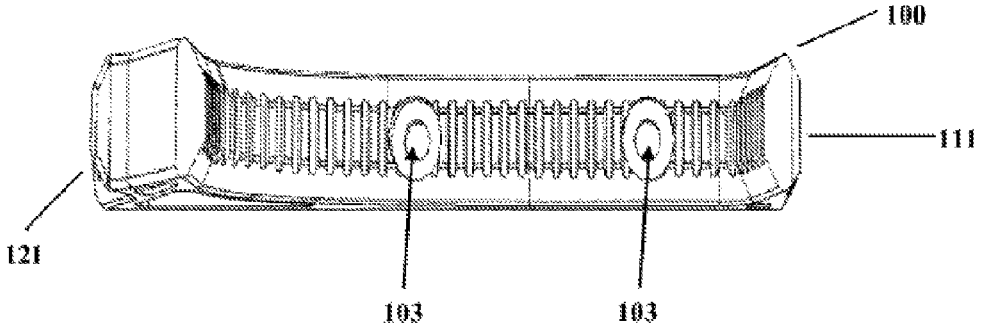
FIG. 2 is a bottom view of the present invention, Multi-Platform Ergonomic Foregrip.
Figure 3:
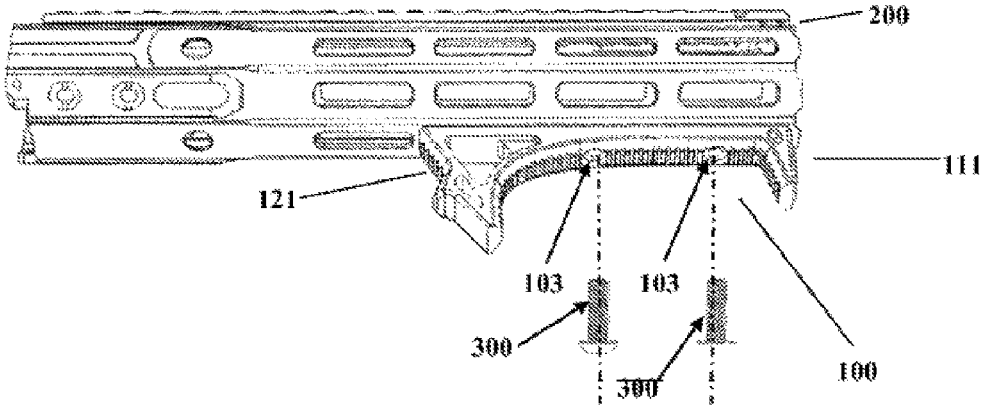
FIG. 3 is an illustration of the present invention positioned on a firearm handguard.
Figure 4:
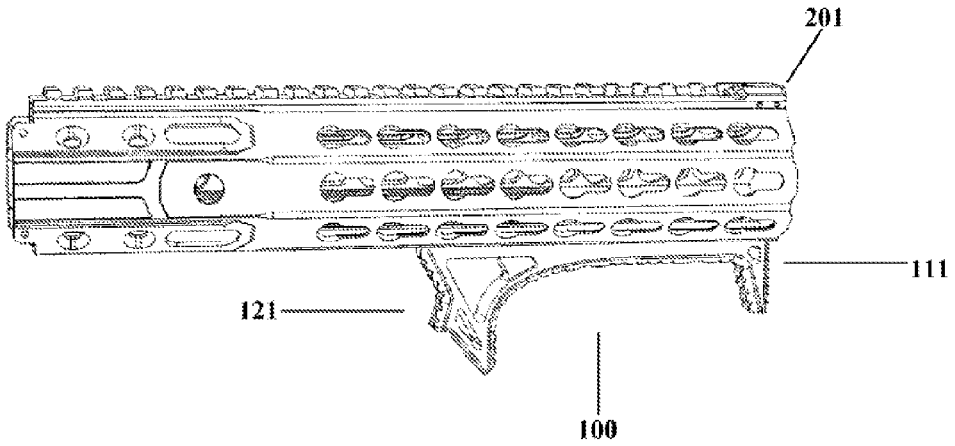
FIG. 4 is an illustration of the present invention attached on one style of firearm handguard.
Figure 5:
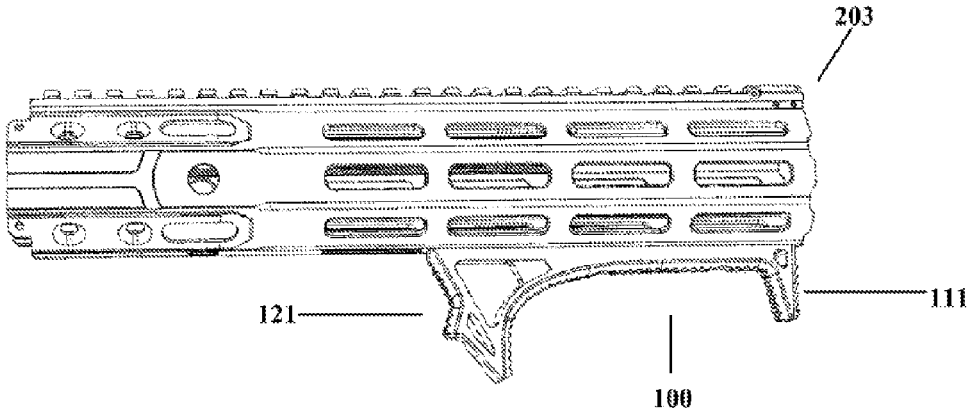
FIG. 5 is an illustration of the present invention attached on another style of firearm handguard.
Figure 6:
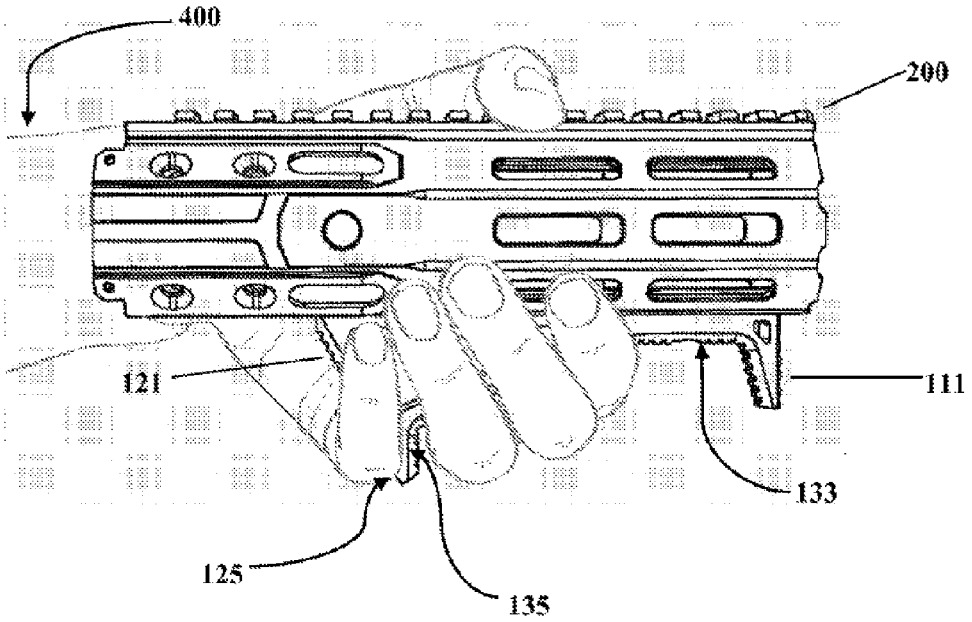
FIGS. 6-9 are illustrations of different methods a shooter can utilizing to hold the firearm handguard.

FIG. 1 is an illustration the present invention, Multi-Platform Ergonomic Foregrip 100. This illustration shows a plurality of engagement, attachment and positioning features. On the top surface of the invention 100, positioning lugs 102 are present to guide a user in the installation process. These lugs 102 allows the invention 100 to be positioned appropriately, prior to securing the apparatus, on different handguard mounting platforms. This is apparent in FIGS. 4 and 5 which each illustrate different mounting platforms, in this case the KeyMod mounting platform and the M-LOK handguard mounting platforms respectively. Insertion of a fastener 300 via fastener holes 103, shown in FIG. 2, and illustrated in FIG. 3 will provide a method for securing the invention 100 onto a firearm handguard 200.

As mentioned, FIG. 1 is an illustration the present invention, Multi-Platform Ergonomic Foregrip 100. The invention 100 further features a front end 111 and a rear end 121 separated by a horizontal engagement portion 133, which runs from the front end, and a curved engagement portion 135 which connected the horizontal engagement portion 133 to the rear end 121.

Figure 7:
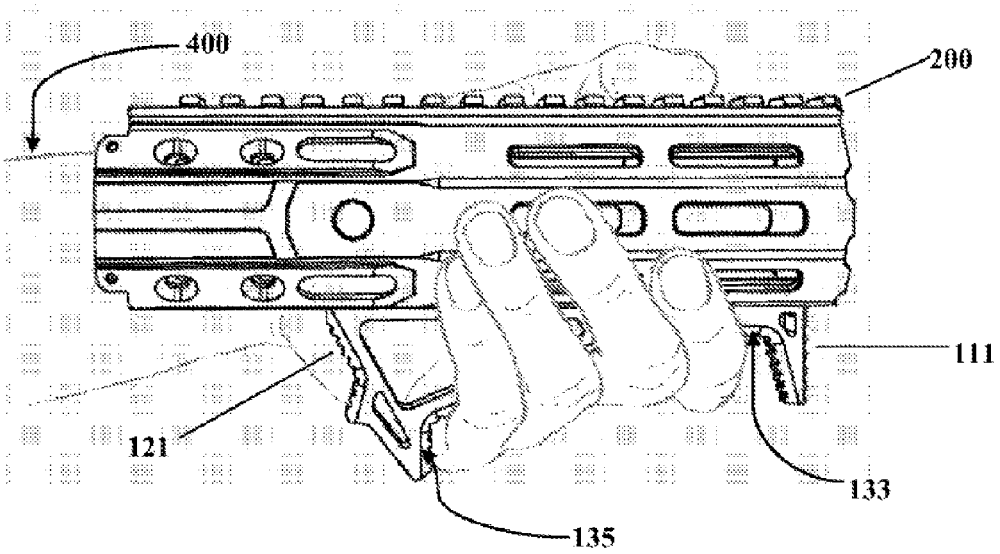
Figure 8:
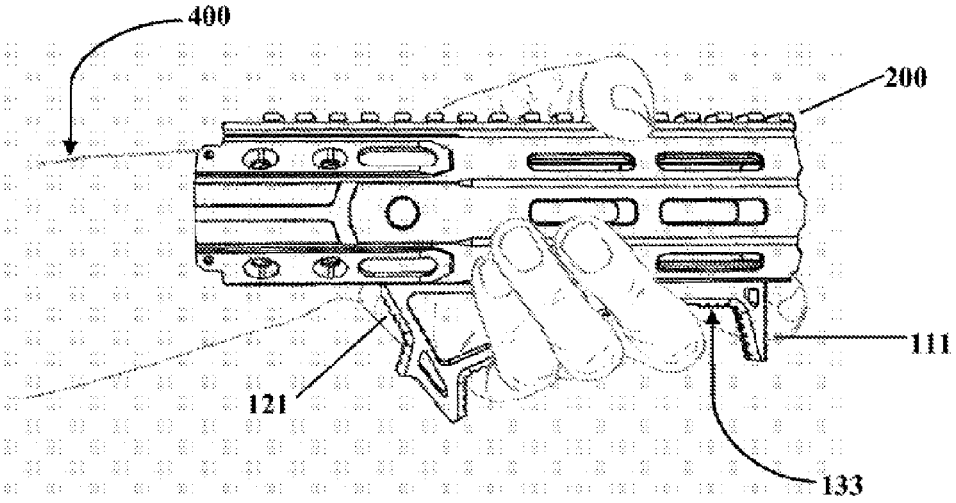
Figure 9:
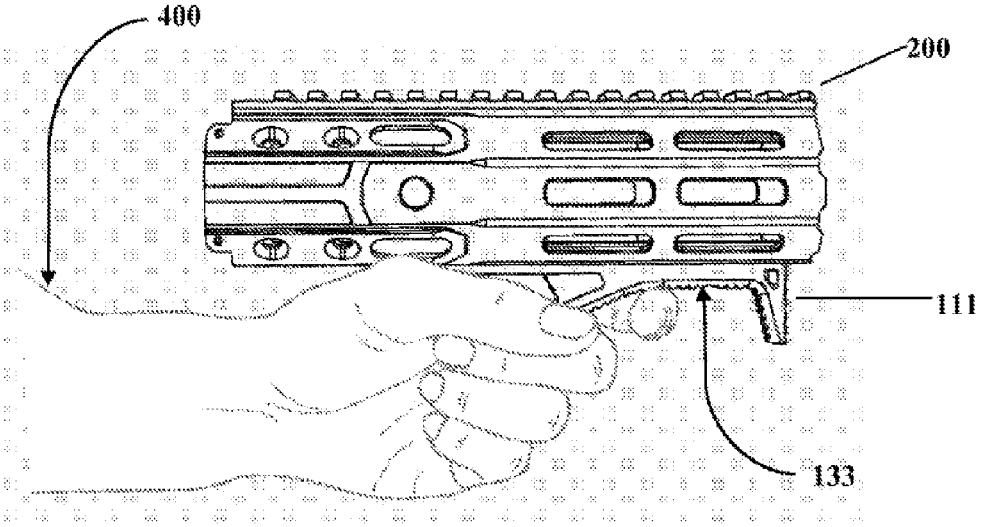

The front end further comprises a vertical member defined by a first vertical engagement surface 113 and a second vertical engagement surface 115 by which a user can utilize in a method similar to that shown in both FIG. 8 and FIG. 9. The rear end 121 further comprises two engagement surfaces wherein a first engagement surface 123, having a first angled grip surface 1231 and a second angled grip surface 1232 connecting at an angle over ninety (90) degrees, provides a position for a user to utilize a method of holding the invention 100, as illustrated in FIG. 7. The rear end 121 also features a second engagement surface 125 by which a shooter can position their hand on the handguard. The invention 100 also features the curved engagement portion 135 and the horizontal engagement surface 133 by which a user can effectively position their hand or a finger to provide additional grip and better firing control as shown in FIGS. 6 through 9.

The invention claimed is:

1. A detachable foregrip for a firearm comprising:

a top surface adapted to engage an attachment rail of a handguard;

a front end vertically extending from the top surface to be substantially perpendicular to the top surface;

a rear end, located at an opposite side of the front end, extending downwardly at a predetermined angle from the top surface; and a horizontal engagement portion underneath the top surface extending between the front end and the rear end, wherein the rear end has a first engagement surface having a first angled grip surface extending inwardly and downwardly at a predetermined angle from the top surface and a second angled griped surface connecting with the first angled grip surface at an angle over ninety degrees, wherein one end of the horizontal engagement portion connects to an inner vertical surface, and the other end thereof connects to a curved engagement portion, and wherein a substantially triangular opening is formed between the top surface, the rear end and the curved engagement portion; a first side of the triangular opening is substantially parallel to the top surface, a second side thereof is substantially parallel to the first angled grip surface, and a third side thereof is substantially parallel to curved engagement portion.

2. The foregrip from claim 1 further comprising a plurality of lugs on the top surface, wherein the lugs provide a means for operably positioning the foregrip to the attachment rail.

3. The foregrip from claim 1, wherein the front end forms a vertical hand engagement portion.

* * * * *